US005750318A

United States Patent [19]

Lambert et al.

[11] Patent Number: 5,750,318

[45] Date of Patent: May 12, 1998

[54] LASER IMAGING ELEMENT

[75] Inventors: Patrick M. Lambert; David P. Trauernicht; Joseph F. Bringley, all of Rochester, N.Y.

[73] Assignee: Eastman Kodak Company, Rochester, N.Y.

[21] Appl. No.: 767,054

[22] Filed: Dec. 16, 1996

[51] Int. Cl.[6] ..... G03C 1/494; G03C 1/705; G03C 1/67; G03C 1/64

[52] U.S. Cl. ..... 430/346; 430/270.16; 430/495.1; 430/541; 430/616; 430/944; 430/964; 524/403; 524/406; 524/413

[58] Field of Search ..... 430/495.1, 964, 430/541, 944, 616, 346, 270.16; 524/403, 406, 413

[56] References Cited

U.S. PATENT DOCUMENTS 5,489,639 2/1996 Faber et al. ..... 524/417

FOREIGN PATENT DOCUMENTS 4402329 8/1995 Germany .
4028757-A 1/1992 Japan .

*Primary Examiner*—Richard L. Schilling
*Attorney, Agent, or Firm*—Harold E. Cole

[57] ABSTRACT

A laser-exposed thermal recording element comprising a support having thereon a pigment layer comprising a pigment dispersed in a polymeric binder, the pigment absorbing at the wavelength of a laser used to expose the element, wherein the pigment comprises the formula:

$$Cu_{2-x}M_x(OH)_yR_z:M'_w$$

wherein:

M is at least one metal atom,

M' is at least one alkali metal,

R is at least one anion, w is between 0 and 2, x is between 0 and 1.5, y and z are selected to maintain charge neutrality, with the proviso that w, x and z cannot all be 0.

18 Claims, No Drawings

LASER IMAGING ELEMENT

This invention relates to laser imaging elements, and more particularly to such elements which are used in medical imaging.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Another way to thermally obtain a print using the electronic signals described above is to use a laser instead of a thermal printing head. In such a system, the donor sheet includes a material which strongly absorbs at the wavelength of the laser. When the donor is irradiated, this absorbing material converts light energy to thermal energy and transfers the heat to the dye in the immediate vicinity, thereby heating the dye to its vaporization temperature for transfer to the receiver. The absorbing material may be present in a layer beneath the dye and/or it may be admixed with the dye. The laser beam is modulated by electronic signals which are representative of the shape and color of the original image, so that each dye is heated to cause volatilization only in those areas in which its presence is required on the receiver to reconstruct the color of the original object. Further details of this process are found in GB 2,083,726A, the disclosure of which is hereby incorporated by reference.

Conventional silver halide laser imaging employs costly media and requires a processing step. The latter requires the maintenance of a processor and the accompanying chemistries for development and fixing, and the periodic disposal of spent chemicals. Dry silver technologies (i.e., silver behenate) require thermal development of an image, which may be obtained using a laser, and the incorporation of a developing agent. The derived images are conspicuous for their lack of stability. In laser ablation of dye combinations, toxic decompositions are produced which must be collected and disposed. All of the above technologies normally require solvent coating of the media which have undesirable environmental problems.

JP 4028757-A relates to an epoxy/resin composition suitable for writing by laser-containing filler, e.g., zirconia, talc, etc., curing agent and copper hydroxide which is changed to cupric oxide on heating with a laser. This JP reference uses copper hydroxide which decomposes to give dark images. However, in medical imaging, a significant emphasis is placed on the throughput of images, i.e., how many images can be produced in a given time period. This is directly proportional to the laser writing speed, which is then correspondingly related to the thermal conversion temperature of the imaging materials. The thermal conversion temperature of copper hydroxide is high and limits the throughput of images. Further, the images obtained have an undesirable brown tone.

DE 4402329 discloses the use of basic copper phosphate for laser-writable coatings which give light-fast marks with high contrast when exposed with an infrared or ultraviolet laser and allow one to produce colored images. However, there is a problem with this material in that it has a high conversion temperature, as will be shown hereafter.

U.S. Pat. No. 5,489,639 discloses a laser-markable thermoplastic composition which contains a copper phosphate salt, copper sulfate, cupric hydroxide phosphate or copper thiocyanate. However, there is a problem with these materials in that they have a high conversion temperature, as will be shown hereafter.

It is an object of this invention to provide a laser-imageable material which has a faster throughput time than that of the prior art materials. It is another object of the invention to provide a laser-imageable material which does not have an undesirable brown tone upon imaging. It is yet another object of this invention to provide a laser-imageable material which has improved lightbox stability.

These and other objects are achieved in accordance with this invention which relates to a laser-exposed thermal recording element comprising a support having thereon a pigment layer comprising a pigment dispersed in a polymeric binder, the pigment absorbing at the wavelength of a laser used to expose the element, wherein the pigment comprises the formula:

$$Cu_{2-x}M_x(OH)_yR_z:M'_w$$

wherein:

M is at least one metal atom,

M' is at least one alkali metal,

R is at least one anion, w is between 0 and 2, x is between 0 and 1.5, y and z are selected to maintain charge neutrality, with the proviso that w, x and z cannot all be 0.

In a preferred embodiment of the invention, M is nickel, cobalt, manganese, magnesium, cerium, iron, zinc, silver or zirconium. In another preferred embodiment, M' is lithium, sodium or potassium. In still another preferred embodiment, R is hydroxide, a carboxylic acid salt, an amino acid salt, an infrared-absorbing dye or iodate. In yet still another preferred embodiment, w is 0, x is 0, y is 3, z is 1, and R is acetate, butyrate, propionate, isobutyrate or octanoate. In another preferred embodiment, w is 2, x is 0, y is 4, z is 0, and M' is sodium. In yet still another preferred embodiment, w is 0.5, x is 0, y is 4, z is 0, and M' is lithium. In still another preferred embodiment, w is 0, x is 0.2, y is 3, z is 1, M is silver, and R is acetate. In still another preferred embodiment, R is an infrared-absorbing dye. In yet still another preferred embodiment, w is 0, x is 0, y is 3, z is 1, and R is iodate.

Another embodiment of the invention relates to a process of forming a single color image comprising imagewise-exposing by means of a laser, in the absence of a separate receiving element, a laser-exposed thermal recording element as described above, thereby imagewise-heating the pigment layer and causing it to change color, thereby creating the single color image.

By use of the metal hydroxide-based compositions described in the invention, the decomposition, or conversion temperatures, are lower than the conversion temperatures of copper hydroxide described in the prior art. A lower conversion temperature translates to a faster writing speed, and hence, greater throughput. In addition, an image tone closely resembling that of silver halide is obtained. Further, the imaging elements of this invention can be conveniently coated out of a variety of water-based polymers or gelatin.

Still further, the by-products of laser writing with the elements of this invention are non-toxic, and are confined as integral components of the coating. In addition, the Dmin tone of the unexposed media described herein is consistent with accepted radiographic images.

Imaging with a compound, such as $Cu(OH)_2$, is accompanied by thermal dehydration of the compound to yield the brown-to-black CuO composition. The dehydration occurs above ~175° C., which is easily obtained with exposure from commercially available red or IR lasers. Improvements to the process would include a reduction in the thermal energy required to achieve the dehydration or generate a black decomposition product. This can be accomplished in several ways:

1) addition or inclusion of a metal salt (M') which accelerates the dehydration or decomposition.

2) partial substitution of hydroxide by other ligands (R), or partial substitution of Cu by other metals (M) yield a less stable hydroxide composition that dehydrates at a lower temperature. By requiring less energy for the dehydration, less energy needs to be deposited per unit area. This translates directly to increased writing speed, and, higher throughput.

3) partial substitution of hydroxide by other anions (R) which, through the decomposition of the ligand, yield a dark product at a lower energy density (e.g., R is an organic salt).

4) preheating, or predecomposing the metal hydroxide; thereby reducing the amount of thermal energy required to complete the conversion to the black oxide.

Alkali melt salts, such as lithium acetate, sodium acetate, and the analogous hydroxides appear to accelerate the dehydration of $Cu(OH)_2$. Another advantage of admixing alkali metal salts with the $Cu(OH)_2$ is the tone of the exposed area is much closer to that accepted in medical radiography. The blue black tone is contrasted to the brown black tone generated from exposing $Cu(OH)_2$ without the presence of an alkali metal salt.

Basic copper acetate, $Cu_2(OH)_3(OAc)$, is a preferred composition of this invention because of its lower conversion, or darkening, temperature compared to $Cu(OH)_2$. Correspondingly, coatings that contain the basic acetate show faster writing speeds than $Cu(OH)_2$ coatings. X-ray powder diffraction analysis shows that the basic acetate structure is still present to a significant degree in the dark decomposition product. This suggests that the basic acetate structure may be less stable than that of $Cu(OH)_2$, and the incomplete combustion of the acetate anion during decomposition may be the source of a carbon-rich pigmenting byproduct. Note that the basic copper acetate structure is unique and is not an obvious extension of the $Cu(OH)_2$ structure.

The basic copper acetate structure lends itself to the synthesis of several additional compositions of this invention. The compound possesses a layered structure with corrugated sheets of Cu—OH(OAc) coordination spheres. The acetate anions bridge between adjacent sheets. A novel characteristic of this host compound is the ability to exchange the acetate anions for long chain carboxylates, amino acids, organic sulfates, inorganic anions such as $IO_4^-$, $S^{-2}$, and $S_2O_3^{-2}$. Uncharged species such as $NH_3$ are also anticipated. The preparation of the exchanged materials usually requires stirring the basic copper acetate in a ~1M solution containing the dissolved anion of choice.

Some of these materials exhibit lower conversion temperatures than that of the basic copper acetate compound, and several have conversion temperatures below $Cu(OH)_2$. The body color of the exchanged compounds is often bluer than the blue-green color of the basic copper acetate. This allows one to optimize the Dmin tone in a coating. Note, as described above for the case of $Cu(OH)_2$, the use of alkali metal salts also enhances the writing speed for coatings containing basic copper acetate.

Another novel feature is the ability to exchange IR-absorbing dyes into the basic copper acetate structure. Such an intimate association of the laser absorbing dye has obvious implications for rapid heat transfer to the imaging element.

Furthermore, several different metal cations from across the periodic table can be incorporated into the structures of the materials described above, without any reduction in conversion temperature or writing speed. A reduction in conversion temperature and an increase in writing speed are realized with Ag substitution.

The metal hydroxide composition may also be preheated prior to dispersion in such a manner that the light body color is retained, and dehydration is initiated. Less thermal energy is required to complete the conversion to the final dark decomposition product, thus, a faster writing speed is realized.

Finally, many of the copper salts described herein are conveniently precipitated, crystallized or exchanged within a gelatin or polymer solution, allowing designed particle size, coatability and homogeneity.

In general, the particle size of the pigment employed in the invention should be between 0.05–10 μm and the pigment-to-binder weight ratio should be between 0.25 and 5.0. In a preferred embodiment of the invention, the pigment is present in an amount of from about 0.01 g/m$^2$ to about 0.500 g/m$^2$ of the element.

Examples of pigments useful in the invention include the following:

$Cu_{2-x}M_x(OH)_yR_z:M'_w$

| M | x | M' | w | y | R | z |
|---|---|---|---|---|---|---|
| NA* | 0 | Na | 2 | 4 | NA* | 0 |
| NA* | 0 | Li | 0.5 | 4 | NA* | 0 |
| NA* | 0 | NA* | 0 | 3 | acetate | 1 |
| NA* | 0 | NA* | 0 | 3 | butyrate | 1 |
| NA* | 0 | NA* | 0 | 3 | propionate | 1 |
| NA* | 0 | NA* | 0 | 3 | isobutyrate | 1 |
| NA* | 0 | NA* | 0 | 3 | octanoate | 1 |
| NA* | 0 | NA* | 0 | 3 | glycine | 1 |
| NA* | 0 | NA* | 0 | 3 | l-aspartic | 1 |
| NA* | 0 | NA* | 0 | 3 | iodate | 1 |
| Ag | 0.2 | NA* | 0 | 3 | acetate | 1 |
| Fe | 0.02 | NA* | 0 | 3 | acetate | 1 |
| Zr | 0.02 | NA* | 0 | 3 | acetate | 1 |
| Ce | 0.02 | NA* | 0 | 3 | acetate | 1 |
| Ni | 0.2 | NA* | 0 | 3 | acetate | 1 |
| Mg | 0.5 | NA* | 0 | 3 | acetate | 1 |
| Zn | 1.0 | NA* | 0 | 3 | acetate | 1 |
| Co | 1.75 | NA* | 0 | 3 | acetate | 1 |

*NA-not applicable

The pigment layer of the recording element of the invention may also contain an ultraviolet-absorbing dye, such as a benzotriazole, a substituted dicyanobutadiene, an aminodicyanobutadiene, or materials such as those disclosed in Patent Publications JP 58/62651; JP 57/38896; JP 57/132154; JP 61/109049; JP 58/17450; or DE 3,139,156, the disclosures of which are hereby incorporated by reference. They may be used in an amount of from about 0.05 to about 10 g/m$^2$.

The recording elements of this invention can be used to obtain medical images, reprographic masks, printing masks, etc. The image obtained can be a positive or a negative image. The process of the invention can generate either continuous (photographic-like) or halftone images.

The invention is especially useful in making reprographic masks which are used in publishing and in the generation of printed circuit boards. The masks are placed over a photosensitive material, such as a printing plate, and exposed to a light source. The photosensitive material usually is activated only by certain wavelengths. For example, the photosensitive material can be a polymer which is crosslinked or hardened upon exposure to ultraviolet or blue light, but is not affected by red or green light. For these photosensitive materials, the mask, which is used to block light during exposure, must absorb all wavelengths which activate the photosensitive material in the Dmax regions and absorb little in the Dmin regions. For printing plates, it is therefore important that the mask have high blue and UV Dmax. If it does not do this, the printing plate would not be developable to give regions which take up ink and regions which do not.

By use of this invention, a mask can be obtained which has enhanced stability to light for making multiple printing plates or circuit boards without mask degradation.

Any polymeric material may be used as the binder in the recording element employed in the invention. For example, there may be used cellulosic derivatives, e.g., cellulose nitrate, cellulose acetate hydrogen phthalate, cellulose acetate, cellulose acetate propionate, cellulose acetate butyrate, cellulose triacetate, a hydroxypropyl cellulose ether, an ethyl cellulose ether, etc.; gelatin; polycarbonates; polyurethanes; polyesters; poly(vinyl acetate); polystyrene; poly(styrene-co-acrylonitrile); a polysulfone; a poly (phenylene oxide); a poly(ethylene oxide); a poly(vinyl alcohol-co-acetal) such as poly(vinyl acetal), poly(vinyl alcohol-co-butyral) or poly(vinyl benzal); or mixtures or copolymers thereof. The binder may be used at a coverage of from about 0.1 to about 5 g/m$^2$.

A barrier layer may be employed in the laser recording element of the invention if desired, as described in U.S. Pat. No. 5,459,017, the disclosure of which is hereby incorporated by reference.

To obtain a laser-induced image according to the invention, an infrared diode laser is preferably employed since it offers substantial advantages in terms of its small size, low cost, stability, reliability, ruggedness, and ease of modulation.

The pigment layer of the recording element of the invention may also have associated therewith an infrared-absorbing material such as cyanine infrared-absorbing dyes as described in U.S. Pat. No. 4,973,572, or other materials as described in the following U.S. Pat. Nos.: 4,948,777; 4,950,640; 4,950,639; 4,948,776; 4,948,778; 4,942,141; 4,952,552; 5,036,040; and 4,912,083, the disclosures of which are hereby incorporated by reference. The infrared-absorbing material may be either in the pigment layer or a layer underneath or on top thereof. The laser radiation is then absorbed into the recording layer and converted to heat by a molecular process known as internal conversion. As used herein, an infrared-absorbing dye has substantial light absorptivity in the range between about 700 nm and about 1200 nm.

Lasers which can be used in the invention are available commercially. There can be employed, for example, Laser Model SDL-2420-H2 from Spectra Diode Labs, or Laser Model SLD 304 V/W from Sony Corp. In addition, other methods for applying thermal energy to the recording elements of the invention may be used such as thermal prints heads.

Any material can be used as the support for the recording element of the invention provided it is dimensionally stable and can withstand the heat of the laser. Such materials include polyesters such as poly(ethylene naphthalate); polysulfones; poly(ethylene terephthalate); polyamides; polycarbonates; cellulose esters such as cellulose acetate; fluorine polymers such as poly(vinylidene fluoride) or poly (tetrafluoroethylene-co-hexafluoropropylene); polyethers such as polyoxymethylene; polyacetals; polyolefins such as polystyrene, polyethylene, polypropylene or methylpentene polymers; and polyimides such as polyimideamides and polyether-imides. The support generally has a thickness of from about 5 to about 200 μm.

A thermal printer which uses a laser as described above to form an image on a thermal print medium is described and claimed in U.S. Pat. No. 5,168,288, the disclosure of which is hereby incorporated by reference.

Image dyes could also be added to the recording layer of the invention such as those dyes disclosed in U.S. Pat. Nos. 4,541,830; 4,698,651; 4,695,287; 4,701,439; 4,757,046; 4,743,582; 4,769,360; and 4,753,922, the disclosures of which are hereby incorporated by reference.

EXAMPLES

The following examples are provided to illustrate the invention.

All of the chemicals used in the following examples are of reagent grade unless otherwise specified. Hydration numbers for starting materials and products are approximate or undetermined, with no implications to the formula above. Also, stoichiometries and ion charges should not be considered definitive, but rather, approximate, as deduced from established chemistry.

The coated samples were evaluated on a drum scanner system consisting of a 13 cm diameter drum which was 25 cm long. The samples were mounted on the outside surface of the drum. The rotational speed of the drum could be varied from 1–800 rev/min. A diode laser (827 nm) was aimed perpendicular to the drum surface, and was focussed to a 6μ×8μ 1/e$^2$ full width spot at the sample surface. The laser power could be varied from 0–100 mW. The pitch of the scan was 5μ for all rotational speeds. The focal position of the laser was adjusted to accommodate the different substrate thickness. Writing speed was determined by two methods, or the combination of these methods; 1) comparison of the rotational speed required to give equivalent optical density in the exposed areas (higher rev/min indicates faster writing speed); and/or 2) comparison of optical density in exposed areas written at the same rotational speed (higher optical density indicates faster writing speed).

The anticipated writing speed in a coating of a material was approximated by the "conversion" temperature of the material. The compound was loaded into a melting point capillary, and observed in the oil bath of a melting point unit as the temperature was increased. With the same rate of temperature increase, the conversion temperature is considered as the midpoint of the temperature range where the compound changed color to a brown-black or black tone. Optical densities were measured on a transmission densitometer (X-rite, Inc.).

Example 1

Copper Hydroxide and Basic Copper Acetate Writing Speeds

This example compares the writing speeds of a $Cu(OH)_2$ (x=0, y=4) coating and a basic copper acetate (x=0, y=3, R=acetate, z=1) coating.

Control C1:

Copper hydroxide, $Cu(OH)_2$, was prepared by the precipitation of a ~0.5M $CuCl_2$ solution with a 5 wt % aqueous NaOH solution at 25° C. The amorphous blue precipitate was collected by vacuum filtration and washed with copious amounts of water, until free of $Na^+$ ion. The collected material was air dried.

A copper hydroxide dispersion was prepared by the combination of 3.00 g of $Cu(OH)_2$, 9.24 g of a 13 wt % solution of Permuthane (ICI) dissolved in 93:7 (w/w) methylene chloride/methanol, 55.0 g of 93:7 (w/w) methylene chloride/methanol and 165 g of 0.3 cm ceramic milling beads in a 125 ml plastic bottle. The dispersion was milled until the average particle size was 1–2μ, and was then coated using a 125 mμ doctor blade on a clear 175 mμ Estar® plastic support. The writing speed was 30 rev/min.

Invention E1:

Basic copper acetate was prepared as follows: 3.0 g of $Cu(acetate)_2H_2O$ was dissolved in 160 ml of distilled $H_2O$. A dilute NaOH solution (0.902 g NaOH in 40 ml of distilled water) was slowly added to the stirred solution. The bright blue-green precipitate was collected by vacuum filtration, washed with 1 L of distilled water and air-dried.

A basic copper acetate dispersion was prepared by combining 2.79 g of $Cu_2(OH)_3(OAc)$, 8.55 g of a 13 wt % solution of Permuthane (ICI) dissolved in 93:7 (w/w) methylene chloride/methanol, 45.2 g of 93:7 (w/w) methylene chloride/methanol and 165 g of 0.3 cm ceramic milling beads in a 125 ml plastic bottle. The dispersion was milled until the average particle size was 1–2μ, and was then coated using a 125 mμ doctor blade on a clear 175 mμ Estar® plastic support. The writing speed was 60 rev/min.

The basic copper acetate coating of the invention exhibits significantly faster writing speed than that of the prior art $Cu(OH)_2$ coating.

To verify the correlation of conversion temperature to writing speed, the conversion temperatures of powders used in C1 and E1 were measured. The $Cu(OH)_2$ had a conversion temperature range of 170°–175° C., while the basic copper acetate of the invention has a conversion temperature range of 135°–145° C. The above data show that the invention elements have lower conversion temperatures.

Example 2

Alkali Metal (M'=Sodium) Salt Effect on Writing Speed

This example demonstrates the effect of mixing an alkali metal salt, in this case, sodium acetate, with $Cu(OH)_2$.

For C2 and E2–E4 a source dispersion was prepared by dissolving 4.40 g of gelatin (Eastman Kodak) in warm distilled water, followed by the addition of 10 g of $Cu(OH)_2$ (prepared as in C1). The mixture was transferred to a 500 ml plastic bottle containing 550 g of 0.3 cm ceramic milling beads. 0.33 ml of antifoam-289 (Sigma) was added and the dispersion ball-milled for 7 days. The final particle size of the copper hydroxide was 1–2μ.

Control C2:

0.33 ml of gelatin hardener (HAR-2088, Eastman Kodak Co.) and 0.065 ml of Triton-Xâ 100 surfactant was added to a 15 ml aliquot of the source dispersion. This mixture was then coated on a clear, gelatin-subbed, Estar plastic support using a 125 mμ doctor blade at a coating block temperature of 10°–15° C.

Invention E2:

The preparation was identical to that of Control C2, except for the addition of 0.34 ml of a sodium acetate solution to the dispersion immediately after the addition of the surfactant. This gave a [Na]/[Cu] molar ratio of 0.1 (w is 0.2).

Invention E3:

Same as E2, except that 1.70 ml of the sodium acetate solution was added. This gave a [Na]/[Cu] molar ratio of 0.5 (w is 1.0).

Invention E4:

Same as E2, except that 3.40 ml of the sodium acetate solution was added. This gave a [Na]/[Cu] molar ratio of 1.0 (w is 2).

The above coatings were printed as above at two different writing speeds. The optical density was evaluated qualitatively for the darkness of the mark as follows: no mark, slight mark, heavy mark and very heavy mark. The following results were obtained:

TABLE 1

Effect on $Na_w$ on writing speed of copper hydroxide coatings

| Example | w | 30 rev/min | 60 rev/min |
|---|---|---|---|
| C2 (Control) | 0 | slight mark | no mark |
| E2 | 0.2 | slight mark | no mark |
| E3 | 1.0 | heavy mark | slight mark |
| E4 | 2.0 | very heavy mark | slight mark |

As can be seen from the above table, as the sodium level increases, the optical density in the exposed areas increases (mark intensity increases), thus indicating an increase in writing speed.

Example 3

Alkali Metal Salt (M'=Lithium) Effect on Writing Speed

This example demonstrates the effect of mixing an alkali metal salt, in this case, lithium acetate, with $Cu(OH)_2$. The difference in writing speed is indicated by an increase in the optical density of lines written at the same rotational speed.

Crystalline $Cu(OH)_2$ was prepared by first dissolving 99.872 g of $CuSO_4.5H_2O$ in 800 ml of hot (70° C.) distilled water followed by the dropwise addition of 86 ml of 6M $NH_4OH$ to yield the basic sulfate salt. The green precipitate was collected by vacuum filtration and washed 4X with 200 ml of hot distilled water. The moist cake was then triturated with 300 ml of a 5 wt % NaOH solution. The blue $Cu(OH)_2$ was collected and washed as above. The crystalline $Cu(OH)_2$ x-ray pattern was verified by powder diffractometry.

Control C3:

Very fine (<1μ) $Cu(OH)_2$ was prepared by dissolving 6 g of the $Cu(OH)_2$ prepared above in 600 ml of 12M $NH_4OH$, followed by the rapid addition of 300 ml of acetone. The milky blue-white precipitate was collected by vacuum filtration and dried in air. One gram of this material was combined with 0.4 g of Permuthane® (ICI PLC) binder, and 99 g of methylene chloride/methanol (93/7) solvent in a 4 dram vial. One and a half g of 2 mm glass beads were added and the sealed vial agitated on a paint shaker for 1 hour. The dispersion was coated with a 75 mμ blade on 175 mμ subbed Estar®. The coating exhibited a weak line when written at 60 rev/min. The difference in optical density between written and unwritten regions at this rotational speed was 0.075.

Invention E5:

Fine particle $Cu(OH)_2$ from C3 was treated with 25 mol % Li(CH3CO2).2$H_2O$ methanolic solution. The sample was air dried with stirring. 1 gram of this material was combined with 0.4 g of Permuthane® binder, and 99 g of methylene chloride/methanol (93/7) solvent in a 4 dram vial. 1.5 g of 2 mm glass beads were added and the sealed vial agitated on a paint shaker for 1 hour. The dispersion was coated with a 75 mμ blade on 175 mμ subbed Estar®. An easily observable line was written at 60 rev/min. The difference in optical density between written and unwritten regions of this coating was 0.415.

The above results show that an increase in optical density is obtained if lithium is present. This translates to an increase in writing speed.

Example 4

Metal Substitution into Basic Copper Acetate (R=OAc, M=Ag)

Comparison C4:

10 g of copper acetate monohydrate was dissolved in 600 ml of distilled water. A dilute NaOH solution (3.15 g in 200 ml) was added dropwise into the stirred solution. After addition, the blue-green precipitate was collected by vacuum filtration and washed with 500 ml of distilled water.

Invention E6:

10 g of copper acetate monohydrate and 0.418 g of silver acetate (x=0.1) were dissolved in 600 ml of distilled water. A dilute NaOH solution (3.15 g in 200 ml) was added dropwise into the stirred solution. After addition, the blue-green precipitate was collected by vacuum filtration and washed with 500 ml of distilled water.

Invention E7:

10 g of copper acetate monohydrate and 0.835 g of silver acetate (x=0.2) were dissolved in 600 ml of distilled water. A dilute NaOH solution (3.3 g in 200 ml) was added dropwise into the stirred solution. After addition, the blue-green precipitate was collected by vacuum filtration and washed with 500 ml of distilled water.

Coatings of these materials were prepared in gelatin (Eastman Kodak) at a P/B ratio of 2.5:1 in a similar manner to the above examples.

The conversion temperatures of the powders and the writing speeds of the coatings are shown below in Table 2:

TABLE 2

Writing speeds and conversion temperatures for M = Ag; R = OAc

| Example | x | Conversion Temperature (°C.) | Writing Speed |
|---|---|---|---|
| C4 (Comparison) | 0 | 140–145 | 60 |
| E6 | 0.1 | 130–135 | 90 |
| E7 | 0.2 | 115–120 | 90 |

The above results again demonstrate the correspondence between conversion temperature and writing speed. The addition of Ag to the inventive basic copper acetate lowers the conversion temperature and increases the writing speed.

Example 5

Exchanged Dye in Basic Copper Acetate (R=OAc, Dye)

$Cu_2(OH)_3(OAc)$ is a layered compound having sheet-like arrangements of $Cu^{2+}$ and $OH^-$ ions separated and linked by acetate layers. This example shows that among the various charged molecules that can be intercalated or exchanged into the layered structure of $Cu_2(OH)_3(OAc)$, IR-absorbing dyes are particularly effective.

Comparison C5:

A basic copper acetate dispersion was prepared by the combination of 1.00 g of $Cu_2(OH)_3(OAc)$ (see above for preparation), 3.08 g of a 13 wt % solution of Permuthane (ICI) binder dissolved in 93:7 (w/w) methylene chloride/methanol, 25.0 g of 93:7 (w/w) methylene chloride/methanol and 75 g of 0.3 cm ceramic milling beads in a 100 ml glass bottle. The dispersion was milled until the average particle size was 1–2μ, and was then coated using a 125 mμ doctor blade on a clear 175 mμ Estar® plastic support. The writing speed was 60 rev/min.

Invention E8:

0.050 g of an anionic enamine tricarbocyanine IR-absorbing dye was dissolved in 25 ml of methanol, and then added to a 1.00 g suspension of $Cu_2(OH)_3(OAc)$ in 25 ml of distilled water with stirring. The suspension was stirred for 5 hours and then the solid collected by vacuum filtration. The filtrate was clear and colorless, indicating that the laser dye had been completely intercalated, or exchanged, into the copper basic acetate host. The solid was allowed to air dry, and then was coated as shown for Control C3. The writing speed was 240 rev/min.

The above results show that the exchange of charged IR-absorbing dyes for the carboxylate groups of the basic copper carboxylates dramatically improves the writing speed of the resulting medium.

Example 6

Conversion Temperature and Writing Speed for Basic Copper Butyrate (x=0, y=3, z=1, R=Butyrate)

Invention E9:

The basic copper butyrate compound was prepared by stirring 1.00 g of basic copper acetate in a dilute solution of sodium butyrate. The conversion temperature of this compound was found to be 115°–120° C. 1 g of this material was combined into a 4 dram glass vial with 0.4 g of poly(methyl methacrylate) binder in 5 g acetone. 1.5 g of 2 mm glass beads were added as media, and the mixture shaken for a hour on a paint shaker. The dispersion (light blue) was coated on 175 mμ clear estar support with a 75 mμ blade. The coating was written upon easily at 60 rev/min with a faint mark observed at 120 rev/min. The results are summarized in Table 3 below with C1 as as control:

TABLE 3

Basic copper butyrate results

| Example | Conversion Temperature (°C.) | Writing Speed | 60 rev/min ΔOD |
|---|---|---|---|
| C1 | 170–175 | 30 | 0.075 |
| E9 | 115–120 | 120 | 0.62 |

The above results show that a fourfold increase in writing speed is obtained using basic copper butyrate as compared to the $Cu(OH)_2$ coating described in C1, as would be expected from the differences in conversion temperature. This increase in performance is also indicated by the change in optical density upon writing at 60 rev/min.

Example 7

Other Exchanged Basic Copper Compounds (R=Carboxylate)

Other basic copper salts (E10, E11, E12 and C6) were formed by mixing aqueous solutions of the sodium salts of the carboxylic acids, or dilute solutions of the carboxylic acids with a small amount (0.25–1.00 g) of copper basic acetate, $Cu_2(OH)_3(OAc)$, prepared as described above. It was assumed that the excess of exchange anion ensured complete substitution. Some samples were examined with x-ray powder diffraction to verify the change in the basal plane distance of the layered basic copper carboxylate structure from that of the basic acetate. Below, in Table 4, the conversion temperatures of several of these materials are compiled (including the R=acetate and butyrate examples previously described):

TABLE 4

R = Carboxylic acid anions

| Example | Exchange Anion | Color | Conversion Temperature |
|---|---|---|---|
| E1 | acetate | green | 135–145° C. |
| E9 | butyrate | blue | 115–120° C. |
| E10 | propionate | blue | 115–127° C. |
| E11 | isobutyrate | light green | 163–168° C. |
| E12 | octanoate | blue-green | 105–115° C. |
| C6 (control) | formate | light green | >200° C. |

The above results show that the conversion temperature decreases with increases in the length of the carbon chain in the carboxylic acid. Based on the coating control shown in E9 above, this reduction will correspond to an increase in writing speed. All of these materials exhibited conversion temperatures lower than that of $Cu(OH)_2$. The basic formate composition of C6 is an example of an exchanged material with a decomposition temperature higher than that of $Cu(OH)_2$.

Example 8

Amino Acid Exchange in Basic Copper Acetate

Amino acids can be exchanged into the copper basic acetate structure similarly to the carboxylic acid examples described above.

Invention E13:

0.25 g of copper basic acetate (prepared as above) was added to a 0.1M solution of the sodium salt of glycine, $NaCO_2CH_2NH_2.nH_2O$. After 45 minutes of stirring, the exchanged material was collected by vacuum filtration and air dried. The conversion temperature was 135°–142° C.

Invention E14:

0.25 g of copper basic acetate (prepared as above) was added to a 0.1M solution of the potassium salt of L-aspartic acid $KCO_2NH_2CHCH_2CO_2.nH_2O$. After 3 hours of stirring, the exchanged material was collected by vacuum filtration and air dried. The conversion temperature was 150°–155° C.

The data show that the basic amino acid copper salts (R=amino acid) have a lower conversion temperature than that of the prior art $Cu(OH)_2$, and thus would result in faster writing speeds.

Example 9

Inorganic Anion Exchange into Basic Copper Acetate ($R=IO_4^-$)

Invention E15:

0.25 g of basic copper acetate was stirred into a 0.5 M solution of $NaIO_4$, let stand overnight, and then collected by vacuum filtration. The green compound had a conversion temperature of 150° C.

The example demonstrates that the substitution of inorganic anions for hydroxide can yield materials which have lower conversion temperatures than that of $Cu(OH)_2$, C1.

Example 10

The examples below show that a wide range of metal cations can be substituted into the basic copper acetate composition without negatively impacting the inventive qualities. The universal aspect of M substitution will be described through the range of x=1.75 with examples of different cations (Fe, Zr, Ce, Ni, Mg, Zn, Co).

Iron into Basic Copper Acetate (x=0.02)

Invention E16:

13.00 g of $Cu(OAc)_2.H_2O$ was dissolved in 200 ml of distilled water along with 0.18 g of $Fe(SO_4).7H_2O$. The solution was brought to pH ~7 with the dropwise addition of 11 ml of 6M $NH_4OH$. After stirring for 1.5 hours the blue green product was collected by vacuum filtration and air-dried. The conversion temperature of this material was 135°–140° C.

$Zr^{4+}$ into Basic Copper Acetate (x=0.02)

Invention E17:

6.5 g of $Cu(OAc)_2.H_2O$ was dissolved in 100 ml of distilled water, followed by the addition and dissolution of 0.105 g of $ZrOCl_2.8H_2O$ (Teledyne Wah Chang Albany, RGS). 5 wt % NaOH was added dropwise to this solution until a pH of 7.5 was reached. The blue precipitate was collected by vacuum filtration and air dried. The conversion temperature was 143°–147° C.

$Ce^{4+}$ into Basic Copper Acetate (x=0.02)

Invention E18:

19.967 g of $Cu(OAc)_2.H_2O$ and 0.548 g of $(NH_4)_2Ce(NO_3)_6.nH_2O$ (REacton) were dissolved in 500 ml of distilled water. 250 ml of 0.4M NaOH solution was added dropwise. The precipitated solution was stirred 1 hour and then collected by vacuum filtration, and air dried. The conversion temperature of the blue green precipitate was 146°–153° C.

$Ni^{2+}$ into Basic Copper Acetate (x=0.2)

Invention E19:

5.850 g of $Cu(OAc)_2.H_2O$ and 0.811 g of $Ni(OAc)_2.4H_2O$ were dissolved in 150 ml of distilled water. 25 ml of 5 wt % NaOH was added dropwise to the solution. The precipitated solution was stirred overnight and then collected by vacuum filtration, and air dried. The conversion temperature of the blue green precipitate was 147°–160° C.

$Mg^{2+}$ into Basic Copper Acetate (x=0.5)

Invention E20:

4.874 g of $Cu(OAc)_2.H_2O$ and 1.745 g of $Mg(OAc)_2.4H_2O$ were dissolved in 150 ml of distilled water. 25 ml of 5 wt % NaOH was added dropwise to the solution. The precipitated solution was stirred overnight and then collected by vacuum filtration, and air dried. The conversion temperature of the light blue precipitate was 130°–142° C.

$Zn^{2+}$ into Basic Copper Acetate (x=1.0)

Invention E21:

5.989 g of $Cu(OAc)_2.H_2O$ and 6.585 g of $Zn(OAc)_2.2H_2O$ were dissolved in 200 ml of distilled water and brought to pH ~7 with 5 ml of 6M $NH_4OH$. The precipitate was stirred for 1 hour and collected by vacuum filtration. X-ray powder diffraction indicated the incorporation of $Zn^{2+}$. The air dried material had a conversion temperature of 135°–155° C.

$Co^{2+}$ into Basic Copper Acetate (x=1.75)

Invention E22:

16.556 g of $Co(NO_3)_2.6H_2O$ was dissolved in 200 ml of distilled water, along with 1.963 g of $Cu(NO_3)_2.3H_2O$. 3.5 ml of concentrated $NH_4OH$ was added dropwise. The gray-green precipitate was collected and dried. 0.25 g of this material was exchanged in 100 ml of a 1.0M $NaCH_3CO_2$ solution for three hours with stirring. The decomposition temperature of the composition (nominally $Co_{3.5}Cu_{0.5}(OH)_6(OAc)_2.nH_2O$) was 135°–175° C.

The above materials all have conversion temperatures lower than that of $Cu(OH)_2$, C1.

Example 11

The following examples are controls with the other copper salts cited in the prior art as laser-imaging elements:

Copper Basic Phosphate, $Cu_4(OH)_2(PO_4)_2$-C7

This material is described in DE 440 2329. Examination of commercial copper basic phosphate did not show a conversion temperature up to 250° C. Therefore, this material was made by first dissolving 2.5 g of $CuSO_4.5H_2O$ in 20 ml of distilled water and 3.8 g of $Na_3PO_4.12H_2O$ in 40 ml of distilled water. The copper solution was added directly to the phosphate solution with stirring. The sample was collected by vacuum filtration and air dried. The conversion temperature of the material was measured as >200° C.

Thus the prior art copper basic phosphate had a conversion temperature much higher than the conversion temperature of the materials of the invention.

Example 12

Described below are processes for the production of the imaging elements described herein.

In Situ Preparation of Basic Copper Salts

Invention E23:

The basic acetate can be prepared directly in a gelatin base for convenient dispersion, coating, and particle size control. For example, 6 g of $Cu(OAc)_2.2H_2O$ and 10 g of gelatin (Class 32-Type IV, Eastman Kodak) were added to 120 ml of water. The melt was complete after heating at 60° C. 6M $NH_4OH$ was added dropwise to the stirring melt until a neutral pH was achieved. Crystals of 2–10μ dimensions were observed at this point. The crystals were isolated via cold water dilution of the melt. X-ray powder diffraction of the crystals showed the pattern of basic copper acetate.

Several of the basic copper salts described previously are amenable to preparation via this route. The advantages include particle size control, ease of dispersion and homogeneity Preheating $Cu(OH)_2$ to Increase Writing Speed Invention E24:

Fine particle $Cu(OH)_2$ from C3 was treated at 120° C. for ½ hour. 1 gram of this material was combined with 0.4 g of Permuthane® binder, and 99 g of methylene chloride/methanol (93/7) solvent mixture in a 4 dram vial. 1.5 g of 2 mm glass beads were added and the sealed vial agitated on a paint shaker for 1 hour. The dispersion was coated with a 75 mμ blade on 175 mμ subbed Estar®. An easily observable line was written at 60 rev/min. The difference in optical density between written and unwritten regions of this coating was 0.205 compared with 0.075 for the $Cu(OH)_2$ in C3.

The above results show that an increase in optical density is obtained if the $Cu(OH)_2$ is preheated. This translates to an increase in writing speed.

The invention has been described in detail with particular reference to preferred embodiments thereof, but it will be understood that variations and modifications can be effected within the spirit and scope of the invention.

What is claimed is:

1. A laser-exposed thermal recording element comprising a support having thereon a pigment layer comprising a pigment dispersed in a polymeric binder, said pigment absorbing at the wavelength of a laser used to expose said element, wherein said pigment comprises the formula:

$$Cu_{2-x}M_x(OH)_yR_z:M'_w$$

wherein:

M is at least one metal atom,

M' is at least one alkali metal,

R is a carboxylic acid salt, an amino acid salt, an infrared-absorbing dye or iodate, w is between 0 and 2, x is between 0 and 1.5, .

y and z are selected to maintain charge neutrality, with the proviso that w, x and z cannot all be 0.

2. The element of claim 1 wherein M is nickel, cobalt, manganese, magnesium, cerium, iron, zinc, silver or zirconium.

3. The element of claim 1 wherein M' is lithium, sodium or potassium.

4. The element of claim 1 wherein w is 0, x is 0, y is 3, z is 1, and R is acetate, butyrate, propionate, isobutyrate or octanoate.

5. The element of claim 1 wherein w is 2, x is 0, y is 4, z is 0, and M' is sodium.

6. The element of claim 1 wherein w is 0.5, x is 0, y is 4, z is 0, and M' is lithium.

7. The element of claim 1 wherein w is 0, x is 0.2, y is 3, z is 1, M is silver, and R is acetate.

8. The element of claim 1 wherein said pigment layer has an infrared-absorbing material associated therewith.

9. The element of claim 1 wherein w is 0, x is 0, y is 3, z is 1, and R is iodate.

10. A process of forming a single color image comprising imagewise-exposing, by means of a laser, in the absence of a separate receiving element, a thermal recording element comprising a support having thereon a pigment layer comprising a pigment dispersed in a polymeric binder, said pigment absorbing at the wavelength of a laser used to expose said element, wherein said pigment comprises the formula:

$$Cu_{2-x}M_x(OH)_yR_z:M'_w$$

wherein:

M is at least one metal atom,

M' is at least one alkali metal,

R is a carboxylic acid salt, an amino acid salt, an infrared-absorbing dye or iodate, w is between 0 and 2, x is between 0 and 1.5, y and z are selected to maintain charge neutrality, with the proviso that w, x and z cannot all be 0;

thereby providing said single color image.

11. The process of claim 10 wherein M is nickel, cobalt, manganese, magnesium, cerium, iron, zinc, silver or zirconium.

12. The process of claim 10 wherein M' is lithium, sodium or potassium.

13. The process of claim 10 wherein w is 0, x is 0, y is 3, z is 1, and R is acetate, butyrate, propionate, isobutyrate or octanoate.

14. The process of claim 10 wherein w is 2, x is 0, y is 4, z is 0, and M' is sodium.

15. The process of claim 10 wherein w is 0.5, x is 0, y is 4, z is 0, and M' is lithium.

16. The process of claim 10 wherein w is 0, x is 0.2, y is 3, z is 1, M is silver, and R is acetate.

17. The process of claim 10 wherein said pigment layer has an infrared-absorbing material associated therewith.

18. The process of claim 10 wherein w is 0, x is 0, y is 3, z is 1, and R is iodate.

* * * * *